US006481718B2

(12) United States Patent
Koelling

(10) Patent No.: US 6,481,718 B2
(45) **Date of Patent: *Nov. 19, 2002**

(54) METHOD OF PLAYING BLACKJACK WITH A SIDE WAGER

(75) Inventor: David C Koelling, Spokane, WA (US)

(73) Assignee: Digideal Corporation, Spokane, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/736,113

(22) Filed: Dec. 11, 2000

(65) Prior Publication Data

US 2001/0000933 A1 May 10, 2001

Related U.S. Application Data

(63) Continuation of application No. 09/215,391, filed on Dec. 18, 1998, now Pat. No. 6,158,741.

(51) Int. Cl.[7] ..... A63F 1/00
(52) U.S. Cl. ..... 273/292; 463/12
(58) Field of Search ..... 273/292, 274, 273/309; 463/12, 13

(56) References Cited

U.S. PATENT DOCUMENTS

| | | | | |
|---|---|---|---|---|
| 5,174,579 | A | 12/1992 | Griffiths | 273/292 |
| 5,390,934 | A | 2/1995 | Grassa | 273/292 |
| 5,393,067 | A | 2/1995 | Paulsen et al. | 273/292 |
| 5,566,946 | A | 10/1996 | Parker | 273/292 |
| 5,586,766 | A | 12/1996 | Forte et al. | 273/309 |
| 5,632,485 | A | 5/1997 | Woodland et al. | 273/292 |
| 5,636,843 | A | 6/1997 | Roberts | 273/292 |
| 5,649,705 | A | 7/1997 | String | 273/292 |
| 5,673,917 | A | 10/1997 | Vancura | 273/292 |
| 5,743,532 | A | 4/1998 | Lafferty | 273/292 |
| 5,806,846 | A | 9/1998 | Lofink et al. | 273/292 |
| 5,934,998 | A | 8/1999 | Forte et al. | 463/12 |

*Primary Examiner*—Benjamin H. Layno
(74) *Attorney, Agent, or Firm*—Wells St. John P.S.

(57) ABSTRACT

A method of playing blackjack with a side wager includes a side wager which is typically set at $1 per hand per player. Where the dealer shows a card having a value of ten, and the player shows two cards having a cumulative value of twenty, the player is a winner. Where either of these two conditions are not met, the player loses the side wager. Where the dealer has a ten-value up card and the player has two cards totaling twenty including aces and nines, the player wins a first amount. Where the player's cards are both of the same suit, the player wins a second, typically larger, amount Where the player's cards are of the same rank, e.g. both. Kings, the player wins a third amount. Where the player's cards are both the same rank and the same suit, the player wins a fourth amount. Where the player's cards are both the same suit and the same rank, and also the same suit and rank as the dealer's face up card, the player wins a significantly larger fifth amount. Where both of the player's cards and both of the dealer's cards are the same, e.g. all Queens of diamonds, then the player wins the jackpot Because the game is played with multiple decks of cards, such an occurrence is possible. The game is adapted to both casino table, computer and video gaming device play.

14 Claims, 4 Drawing Sheets

| Dealer's Up Card | Player's Hand | Amount Won |
|---|---|---|
| 10, J, Q or K | Any 20 (including Ace–Nine) | $10.00 |
| 10, J, Q or K | Suited 20 (including Ace–Nine) | $25.00 |
| 10, J, Q or K | Ranked 20 (not suited) | $25.00 |
| 10, J, Q or K | Ranked and Suited 20 | $75.00 |
| Same Rank and Suit as Player | Ranked and Suited 20 | $1,000.00 |
| Upcard and Downcard are Identical to Player's 2 cards | Ranked and Suited 20 | Jackpot |

Fig 3

| Type of Hand; 100,000 dealt from 6 deck, and that dealer shows a card of value 10. | # of winning hands |
|---|---|
| Any 20 not otherwise listed below | 1,746 |
| Any suited 20, not otherwise shown below | 632 |
| Any ranked 20, not otherwise shown below | 540 |
| Any ranked and suited and not otherwise shown below | 143.6 |
| Ranked and Suited and Dealer's up card matches exactly | 6.318 |
| Ranked and Suited and both Dealer's cards match exactly | 0.062 |

Fig 4

| Type of Hand | Suggested Payoff | Money paid out per $100,000 taken in |
|---|---|---|
| Unranked and unsuited 20 | $10.00 (including Ace–Nine) | $17,460.00 |
| Suited 20 | $25.00 (including Ace–Nine) | $15,800.00 |
| Ranked 20 | $25.00 (not suited) | $13,500.00 |
| Ranked and Suited 20 | $75.00 | $10,770.00 |
| Ranked and suited 20 with Dealer upcard matching exactly | $1,000.00 | $6,318.00 |
| Money diverted into the Progressive Jackpot (suggested 10% of the side wager) | $10,000.00 | $10,000.00 |

FIG 5

METHOD OF PLAYING BLACKJACK WITH A SIDE WAGER

CROSS-REFERENCES TO RELATED CASES

This is a continuation of U.S. patent application Ser. No. 09/215,391, filed Dec. 18, 1998, now U.S. Pat. No. 6,158,741.

BACKGROUND

Several blackjack side wagers have appeared in recent years. Top of the Deck is a side bet on whether or not the player and/or dealer will receive a "natural" (a two-card 21).

Over/Under 13 is a side bet on whether the player's first two cards will total over or under 13. The side wager is made at the start of a new hand.

Royal Match (Boylan et al., U.S. Pat. No. 5,098,107) is a side bet on whether the player's first two cards will be of the same suit. The wager is made at the start of the new hand, and is a completely passive bet.

Super 7s is a bet on whether on not the player will receive one or more sevens in his/her hand.

Bust-Out is a side wager which is made while the blackjack hand is in progress. Where the dealer's hand is "stiff," i.e. a hard hand with value between 12 and 16, the players are allowed to wager on whether the next card will have the value of 10.

U.S. Pat. No. 5,632,485, issued in 1997 to Bill M. Woodland and Linda M. Woodland, discloses a side bet for blackjack wherein a player is allowed to wager on whether the player will receive a "stiff" hand. A variation allows the player to bet on whether he/she will be dealt a non-pair "stiff" hand or a pair of aces. In a still further embodiment, a player in a blackjack game is provided with the option of wagering on whether the first two cards will result in a "stiff" hand or a "soft" hand, i.e. that the player's first two cards include an ace and either: 1) any non-ten denomination, i.e., an ace through nine, or 2) any non-ten and non-ace denomination, i.e. two through nine.

U.S. Pat. No. 5,649,705, issued in 1997 to Elizabeth String, discloses a side bet wherein the player elects to bet on the player obtaining a winning hand by placing a wage on a second betting area, or whether to bet on the dealer obtaining a winning hand by placing a wager on a first betting area.

U.S. Pat. No. 5,174,579, issued in 1992 to Steve Griffiths, discloses a side bet to conventional blackjack wherein the player is wagering on whether the dealer will either bust on his hand or achieve a hand count of exactly 21.

U.S. Pat. No. 5,390,934, issued in 1995 to Louis J. Grassa, discloses a side bet to blackjack wherein a player can play not only his own hand against the dealer but by an extra play also those hands of the other players at the table. A first player making an extra play is betting on the outcome of the cards of a second players position, over which the first player has no control.

Destiny 21 (U.S. Pat. No. 5,673,917, issued in 1997 to Olaf Vancura) allows players to wager on the number of hits that they and/or the dealer will ultimately take.

What is needed is a further side wager game associated with blackjack that overcomes the disadvantages of the prior art. In particular, the side wager should give the player an opportunity to win when the dealer has a ten-value card showing, and is therefore somewhat likely to obtain a hand having a difficult-to-beat score of twenty. Additionally, a side wager game with a very large and progressive jackpot is needed to attract player participation.

SUMMARY

The present invention is directed to a method playing blackjack with a side wager that satisfies the above needs, and which is adapted for use with money, gaming chips and/or credits. The method of playing blackjack with a side wager of the present invention provides some or all of the following steps, which are provided in addition to the regular rules of play of the game of blackjack, which may involve one or more players playing against a dealer.

(A) Providing a platform for playing blackjack, wherein the platform is typically a blackjack table or a video gaming device. The platform defines at least one playing position, wherein each of the playing positions defines a wager area and a side wager area.

(B) Each player placing a wager in their wagering area to participate in the blackjack game, and each player placing a side wager in their side wager area to participate in a side wager.

(C) The dealer dealing each of the at least one players a hand of two cards, wherein the first and second cards are both placed face up, and the dealer dealing the dealer a hand of two cards, a first card being placed face up and a second card being placed face down.

(D) If the dealer's face up card has a value of ten, and the total value of the player's hand is 20, then:

(a) The player is paid a first amount.

(b) Or, if the playe's cards are of the same suit, then the player is paid a second amount.

(c) Or, if the player's cards are of equal rank, but not equal suit, then the player is paid a third amount.

(d) Or, if the player's cards are of equal rank and of the same suit, then the player is paid a fourth amount.

(e) Or, if the player's cards are of the same rank and the same suit, and if the player's cards are of the same rank and suit as the dealer's face up card, then the player is paid a fifth amount.

(f) Or, if the player's cards are of the same rank and the same suit, and if the player's cards are of the same rank and suit as the dealer's face up card and face down card, then the player is paid a sixth amount.

(E) Or else, if the dealer's face up card does not have a value of ten, or if the player's two cards do not total 20, then the player forfeits the side wager.

(F) The dealer continues to deal cards and settle the wager of each of the at least one players according to the rules of the game of blackjack.

It is therefore a primary advantage of the present invention to provide a novel method of playing blackjack with a side wager which increases player interest.

Another advantage of the present invention is to provide a novel method of playing blackjack with a side wager which will aid the house or video gaming device owner to increase revenue with little additional capital investment.

A still further advantage of the present invention is to provide a novel method of playing blackjack with a side wager which provides the player with the opportunity to win a very large jackpot.

DRAWINGS

These and other features, aspects, and advantages of the present invention will become better understood with regard to the following description, appended claims, and accompanying drawings where:

FIG. 3 is a table showing the situations resulting in the player winning the side wager, for a preferred version of the invention.

FIG. 4 is a table showing the number of winning hands expected assuming 100,000 hands dealt from a 6-deck shoe, using a preferred version of the invention.

FIG. 5 is a table showing the expected amount of money paid out on 100,000 hands, assuming the side wager amount to be one dollar, as is the case in the preferred version of the invention.

DESCRIPTION

Referring generally to FIGS. 1 through 5, the method of playing blackjack with a side wager in accordance with the present invention is seen. The method includes a side wager which is typically set at $1 per hand per player. Where the dealer shows a card having a value of ten, and the player shows two cards having a cumulative value of twenty, the player is a winner. Where either of these two conditions are not met, the player loses the side wager. Where the dealer has a ten-value up card and the player has two cards totaling twenty including aces and nines, the player wins a first amount. Where the player's cards are both of the same suit, the player wins a second, typically larger, amount. Where the player's cards are of the same rank, e.g. both Kings, the player wins a third amount. Where the player's cards are both the same rank and the same suit, the player wins a fourth amount. Where the player's cards are both the same suit and the same rank, and also the same suit and rank as the dealers face up card, the player wins a significantly larger fifth amount. Where both of the player's cards and both of the dealer's cards are the same, e.g. all Queens of diamonds, then the player wins the jackpot. Because the game is played with multiple decks of cards, such an occurrence is possible. The game is adapted to both casino table, computer and video gaming device play.

Through out the following description, it will be assumed that the value of numbered cards, i.e. cards 2 through 10, have the value of the associated card number, i.e. a value of two through ten. Similarly, the 10, Jack, Queen and King will all have a value of ten. The Ace will have a value of one or eleven. Therefore, for example, a two-card hand having a Jack and a King would have a value of twenty. Similarly, a two-card hand having a nine and an Ace would also have a value of twenty.

The dealer, as referred to in this document, may be either a person or a portion of the functionality included in computer or video gaming device.

Gaming chips, as referred to in this document, may be token chips, actual folding money or coin, or credit cards or accounts. Similarly, particularly where a video gaming device is utilized, the gaming chips may be somewhat theoretical in nature, and may be tied to a credit card or credit account. In any case, gaming chips will represent units of value, either monetarily and/or as a score-keeping tool.

Figure 1:
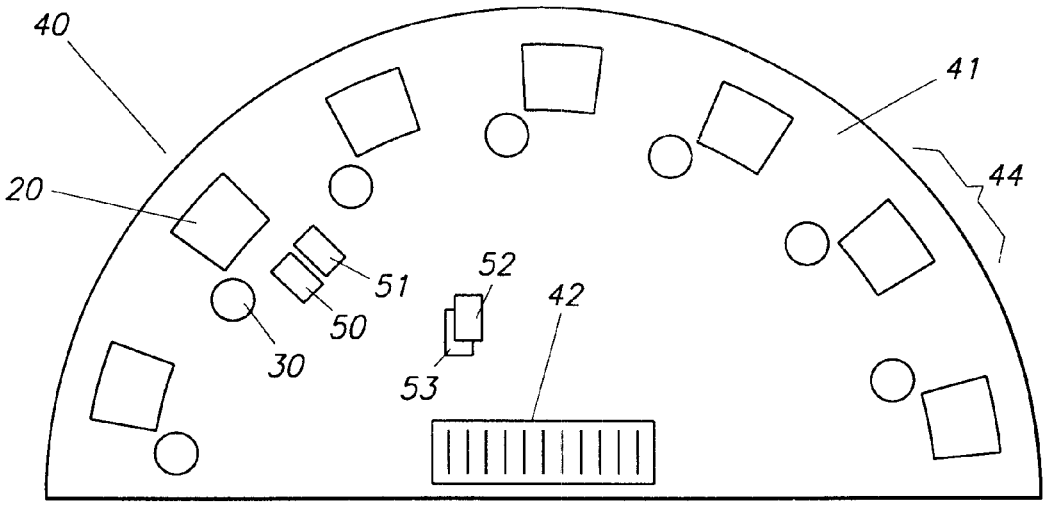
FIG. 1 is a view of a blackjack table modified to serve as the platform of operation of a version of the invention.

A platform 40 for playing blackjack suitable for use with the method of playing blackjack with a side wager includes those platforms, such as casino tables, video gaming devices and computer software that are suitable for use with conventional blackjack. Where the platform is a casino table 41, the platform would include the table itself, a dealer chip tray 42, outlined wagering area 20 and. side wagering area 30 and other conventional items used to play blackjack. FIG. 1 illustrates the use of such a casino table as the platform upon which the game is played.

Figure 2:
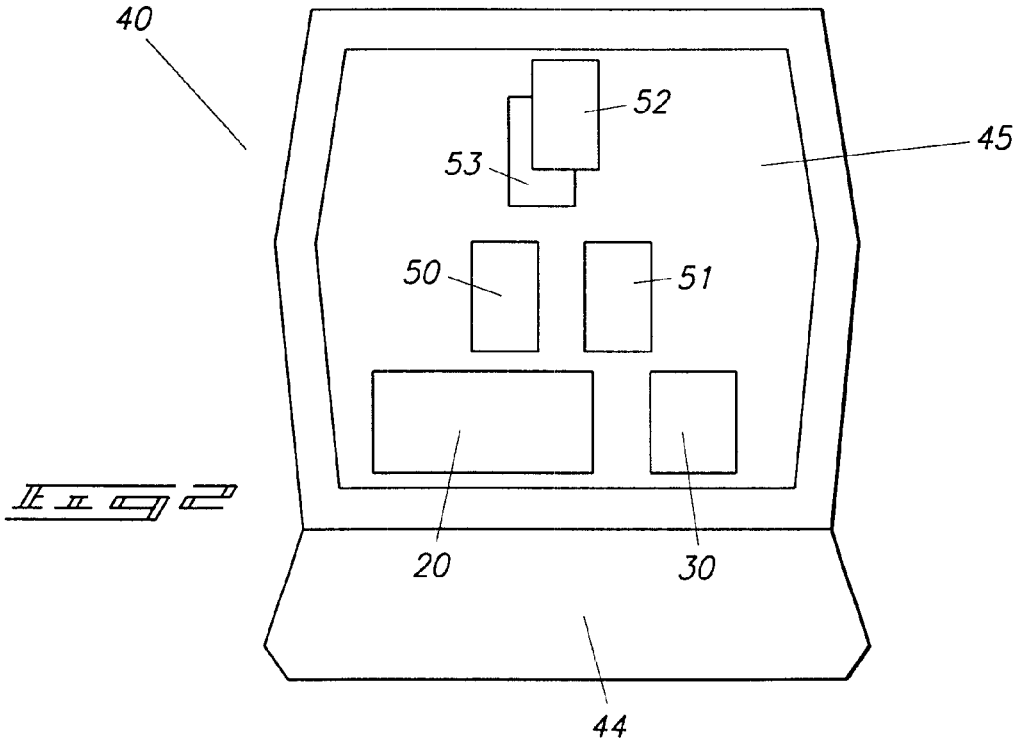
FIG. 2 is a view of an electronic gaming machine adapted to serve as the platform of operation of a further version of the invention.

The side wagering area 30 may include any known structures associated with wagering areas. For example, while the side wagering area may be formed by a line defined on the surface of the casino table 41, it may also include chip sensing devices and slots. Such devices and slots accept a gaming chip or other payment method and then activate a light to indicate that payment has been made. Similarly, a variety of different screen designs are possible for computer and video gaming device type platforms Where the platform 40 includes a video gaming device or computer, the platform includes the required hardware and software that is well-known or easily derived from that which is well-known to support the inventive concepts herein disclosed. FIG. 2 illustrates the use of such a video gaming device 45. Such devices are well-known for use in playing conventional blackjack and many other games. Video gaming devices are typically adapted for use in playing one or more games, and due to their low cost of operation due to the absence of labor costs, are becoming wide-spread.

In some cases where a computer is used, the platform associated with the instant method of playing blackjack with a side wager may include the computer and also a connecting network, e.g. the internet or other network. In such a circumstance, the player's input and the game's output is depicted on the player's computer, while the execution of the method of the side wager is typically performed on a remote host computer.

The platform should define at least one playing position 44. As seen in FIG. 1, a casino type blackjack table may define approximately seven playing positions. Each playing position provides the wagering area 20 and side wagering area 30 required by each player.

The platform should support the use of multiple decks of cards. For example, where the platform includes a casino style table 41, a "shoe" containing six full decks of cards is preferred. Alternatively, another number of full decks may be substituted. However, the number of decks should be selected while taking into account that a minimum of four decks are needed to allow the player to have a chance to win the jackpot. As will be seen below, this is true because to win the jackpot the player and dealer have to have, between them, four identical cards; e.g. four Kings of clubs.

Similarly, where the platform includes a video gaming device or similar computer, the associated software should be designed to include a data structure that reflects the need for at least four, and typically six decks of cards.

To begin each hand of play, each player places a wager on their wagering area 20 to participate in the blackjack game, and each player places a side wager on their side wager area 30 to participate in a side wager.

As seen in FIG. 1, the wagering area 20 in the casino table version of the platform includes an outlined area, within which the player places money, chips or other gaming credits. Similarly, the side wagering area 30 is an outlined area within which the player places the side wager amount.

As seen in FIG. 2, in a video gaming device or computer version of the invention, the wagering area 20 is a space on the screen within which is displayed the value of the wager that the player has allocated for the current hand. Similarly, the side wagering area 30 is a space on the screen within which is displayed the value of the side wager, also known as the side wager amount. This amount may be automatically deducted from the player's credits, and may be a fixed sum which is required of the player prior to the commencement of the hand.

In a preferred embodiment of the invention, the side wager amount is valued at one dollar. However, other values could be used depending on the preferences of the players, the casino, house or video gaming device owner, and on local, state and federal regulations.

After the appropriate wagers and side wagers have been made by the players, the dealer deals each of the at least one players a hand of two cards, wherein the first and second cards 50, 51 are both placed face up. The dealer also deals the dealer a hand of consisting of two cards, a first card 52 being placed face up and a second card 53 being placed face down. The dealer's face up card is also known as an up card; the face down card is also known as a down card.

If the dealer's face up card 52 has a value of ten, and the total value of the player's hand is twenty the player wins the side bet. If either of these circumstances are not the case, then the player loses the side wager and the side wager amount is forfeited to the dealer.

Where the player has a hand in which the two cards total twenty, and the dealer has a hand having a face up card with a value of ten, the player is paid a first amount. In a preferred version of the invention, the first amount is ten dollars. However, in an alternative version of the invention, the first amount could be a greater or lesser value.

For example, where the player's cards include a Queen of diamonds and a Jack of hearts, the cards would be different suits, i.e. diamonds and hearts. Similarly, the cards would be of different rank, i.e. Queen and Jack. Nevertheless, because the dealer's face up card had a value of ten, and the player's hand's value totaled twenty, the player would be qualified to win the first amount.

In a similar circumstance where the player has a hand in which the two cards total twenty, and the dealer has a hand having a face up card with a value of ten, the player may alternatively win a greater second amount, where both of the player's cards are of the same suit. In a preferred version of the invention, the second amount is twenty-five dollars. However, in an alternative version of the invention, the second amount could be a greater or lesser value.

For example, where the player's cards include a Queen of diamonds and a Jack of diamonds, the cards would be of the same suit, i.e. diamonds. Therefore the player would be qualified to win the second amount.

In a still further circumstance where the player has a hand in which the two cards total twenty, and the dealer has a hand having a face up card with a value of ten, the player may alternatively win a third amount, where both of the player's cards are of the same rank. In a preferred version of the invention, the third amount is twenty-five dollars. However, in an alternative version of the invention, the third amount could be a greater or lesser value.

For example, where the player's cards include a Queen of diamonds and a Queen of hearts, the cards would be of the same rank, i.e. the rank of Queen. Therefore the player would be qualified to win the third amount.

In a still further circumstance where the player has a hand in which the two cards total twenty, and the dealer has a hand having a face up card with a value of ten, the player may alternatively win a fourth amount, where both of the player's cards are of the same rank and the same suit. In a preferred version of the invention, the fourth amount is seventy-five dollars. However, in an alternative version of the invention, the fourth amount could be a greater or lesser value.

For example, where the player's cards include two Queens of diamonds, the cards would be of the same rank, i.e. the rank of Queen and the same suit, i.e. diamonds. Therefore the player would be qualified to win the fourth amount. It should be noted that it is possible to have two Queens of diamonds because the invention makes use of multiple decks of cards. Similarly, where an electronic gaming device is used as the platform, the data structure used by the controlling software should support at least four decks of cards.

In a still further circumstance where the player has a hand in which the two cards total twenty, and the dealer has a hand having a face up card with a value of ten, the player may alternatively win a fifth amount, where both of the player's cards are of the same rank and the same suit, and where additionally the dealer's up card is also of the same rank and same suit. In a preferred version of the invention, the fifth amount is one thousand dollars. However, in an alternative version of the invention, the fifth amount could be a greater or lesser value.

For example, where the player's cards include two Jacks of spades, and where the dealer's up card is a Jack of spades, the cards would be of the same rank, i.e. the rank of Jack and the same suit, i.e. spades. Therefore the player would be qualified to win the fifth amount.

In a still further circumstance where the player has a hand in which the two cards total twenty, and the dealer has a hand having a face up card with a value of ten, the player may alternatively win a sixth amount, also known as a jackpot, where both of the player's cards are of the same rank and the same suit, and where additionally the dealer's up card and down card are also of the same rank and same suit. In a preferred version of the invention, the sixth amount is dependent upon the number of hands played since the last jackpot was last won. This is the case because in a preferred version of the invention, ten percent of each side wager is put into the progressive jackpot, causing it to grow over time. The jackpot is typically "seeded" with $2,500.00 to $5,000.00 or more to begin with. Alternatively, a "floor" may be provided, so that if the jackpot is won before reaching a value of $2,500 or $5,000 the player is guaranteed that amount. However, in an alternative version of the invention, the amount could be a fixed, typically at $25,000.00.

For example, where the player's cards include two tens of hearts, and where the dealer's up card is a ten of hearts, and where the dealer's down card is also a ten of hearts, the cards would be of the same rank, i.e. the rank of ten and the same suit, i.e. hearts. Therefore the player would be qualified to win the sixth amount.

Referring to FIG. 3, the six amounts which may be won by the player are associated with the six rows of the table. The three columns show, respectively, the dealer's up card (and in the sixth row the dealer's down card), the player's two cards, and the amount won by the player in each circumstance. The entire table is based on a one dollar side wager, and could be scaled up or down to accommodate alternate values of the side wager. As will be seen, the amounts of the winnings may be varied somewhat.

As seen in row one of FIG. 3, where the dealer has any ten-value card, and the player has any twenty-value hand, the amount won is ten dollars.

As seen in row two of FIG. 3, where the dealer has any ten-value card, and the player has any twenty-value hand, where both of the player's cards are of the same suit, the amount won is twenty-five dollars.

As seen in row three of FIG. 3, where the dealer has any ten-value card, and the player has any twenty-value hand, where both cards are of the same rank, the amount won is twenty-five dollars.

As seen in row four of FIG. 3, where the dealer has any ten-value card, and the player has any twenty-value hand, i.e. combination of 10s, Jacks, Queens and Kings to form a total of twenty, where both cards are of the same rank and also same suit, that the amount won is seventy-five dollars.

As seen in row five of FIG. 3, where the dealer has any ten-value card, and the player has any twenty-value hand, and where both of the player's cards and the dealer's up card are all of the same rank and suit, the amount won is one thousand dollars.

As seen in row six of FIG. 3, where the dealer has any ten-value card, and the player has any twenty-value hand, and where both of the player's cards and the dealer's up card and down card are all of the same rank and suit, the amount won is a jackpot, which will be defined in greater detail below.

Referring to FIG. 4, the expected number of winning hands, per 100,000 hands played, of the six types explained above are seen. Referring to FIG. 5, the expected cost of paying the players for each winning type of hand is seen. The total of the amounts seen in the third column of FIG. 5 is $73,848,00. Since this pay-out rate is based on a player side wager of $1 per hand and is based on 100,000 hands, the house pays out just under $74,000 on an income of $100,000.

As seen in the last row of FIG. 5, it is suggested that 10% of each side wager made be put into a progressive jackpot. As a result, the value of such a jackpot grows progressively. In this circumstance, the cost of the jackpot is easily predicted, and is not influenced by how often the jackpot is won. For example, where the jackpot is won more frequently than the statistically expected rate, the value of each win would be less; similarly, where the jackpot is won less than the statistically expected rate, the value of each win would be more.

After the side wager is resolved, the dealer continues to deal cards and settle the main wager of each of the at least one players according to the rules of the game of blackjack. This typically involves dealing extra cards to players who request "hits," and to dealing cards to the dealer according to the rules of blackjack and any house variations.

The previously described versions of the present invention have many advantages, including a primary advantage of providing a novel method of playing blackjack with a side wager which increases player interest.

Another advantage of the present invention is to provide a novel method of playing blackjack with a side wager which will aid the house or video gaming device owner to increase revenue with little additional capital investment.

A still further advantage of the present invention is to provide a novel method of playing blackjack with a side wager which provides the player with the opportunity to win a very large jackpot.

The invention resides not in any one of these features per se, but rather in the particular combination of all of them herein disclosed and claimed and it is distinguished from the prior art in this particular combination of all of its structures for the functions specified.

Although the present invention has been described in considerable detail and with reference to certain preferred versions, other versions are possible. For example, while suggested winning amounts have been disclosed, it is clear that the same inventive principles would be in operation if the amounts were changed to values outside of the ranges disclosed. In that event, the balance between the house and player winning level would of course be altered; however the nature and method of the side wager would continue in a similar manner. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A method of playing blackjack with a side wager by at least one player against a dealer, comprising the steps of:

(A) providing a platform for playing blackjack, the platform defining at least one playing position, each of the at least one playing positions defining a wager area and a side wager area, wherein at least one player is associated with one of the at least one playing positions;

(B) each player placing a wager on their wagering area to participate in the blackjack game;

(C) each player placing a side wager on their side wager area to participate in a side wager;

(D) the dealer dealing each of the at least one players a hand of two cards, wherein first and second cards are both placed face up, and the dealer dealing the dealer a hand of two cards, a first card being placed face up and a second card being placed face down;

(E) if the dealer's face up card has a value of ten, and the total value of the player's hand is 20, then:

(a) paying the player a first amount; or (b) if the player's cards are of the same suit, then paying the player a second amount; or (c) if the player's cards are of equal rank, but not equal suit, then paying the player a third amount; or (d) if the player's cards are of equal rank and of the same suit, then paying the player a fourth amount; or (e) if the player's cards are of the same rank and the same suit, and if the player's cards are of the same rank and suit as the dealer's face up card, then paying the player a fifth amount; or (f) if the player's cards are of the same rank and the same suit, and if the player's cards are of the same rank and suit as the dealer's face up card and face down card, then paying the player a sixth amount; or (F) if the dealer's face up card does not have a value of ten, or if the player's first and second cards do not total 20, then forfeiting the player's side wager; and (G) continuing to deal cards and settle the wagers of each of the at least one players according to the rules of the game of blackjack.

2. The method of playing blackjack of claim 1, further comprising the step of:

(a) wherein the side wager is one dollar.

3. The method of playing blackjack of claim 1, further comprising the step of:

(a) wherein the first amount is ten dollars.

4. The method of playing blackjack of claim 1, further comprising the step of:

(a) wherein the second amount is twenty-five dollars.

5. The method of playing blackjack of claim 1, further comprising the step of:

(a) wherein the third amount is twenty-five dollars.

6. The method of playing blackjack of claim 1, further comprising the step of (a) wherein the fourth amount is seventy-five dollars.

7. The method of playing blackjack of claim 1, further comprising the step of:

(a) wherein the fifth amount is one thousand dollars.

8. The method of playing blackjack of claim 1, further comprising the step of:

(a) wherein the sixth amount is a progressive jackpot.

9. The method of playing blackjack of claim 8, further comprising the step of:

(a) wherein the progressive jackpot amount includes the sum of a fraction of each side wager made since a previous jackpot was won, plus a seed amount.

10. The method of playing blackjack of claim 1, further comprising the step of:

(a) wherein the sixth amount is twenty-five thousand dollars.

11. The method of playing blackjack of claim 1, wherein the platform comprises a blackjack playing table.

12. The method of playing blackjack of claim 1, wherein the platform comprises an electronic gaming device.

13. The method of playing blackjack of claim 1, wherein the platform comprises a computer and software.

14. The method of playing blackjack of claim 1, wherein the platform comprises a computer that is connected to a network.

* * * * *